US006007296A

United States Patent [19]

Ernst et al.

[11] Patent Number: 6,007,296

[45] Date of Patent: Dec. 28, 1999

[54] GUIDE BLADE FOR STEAM TURBINES

[75] Inventors: Peter Ernst, Stadel; Kurt Faller, Brugg; Reinhard Fried, Nussbaumen, all of Switzerland

[73] Assignee: ABB Research Ltd., Zurich, Switzerland

[21] Appl. No.: 09/032,796

[22] Filed: Mar. 2, 1998

[30] Foreign Application Priority Data

Mar. 8, 1997 [DE] Germany ..... 197 09 607

[51] Int. Cl.[6] ..... F01D 5/14

[52] U.S. Cl. ..... 415/115; 415/169.3; 416/231 R; 416/224; 416/231 B; 411/349; 411/350; 411/549; 411/550; 411/552; 411/553

[58] Field of Search ..... 415/115, 169.3; 416/231 R, 224, 231 B; 411/552, 550, 553, 350, 549, 349

[56] References Cited

U.S. PATENT DOCUMENTS

| | | | |
|---|---|---|---|
| 741,776 | 10/1903 | Dodge | 415/169.3 |
| 3,301,529 | 1/1967 | Wood | 415/169.3 |
| 3,778,190 | 12/1973 | Ouellette | 416/196 |
| 3,881,842 | 5/1975 | Kosyak et al. | 416/168 |
| 4,738,585 | 4/1988 | Von Bockh | 415/115 |
| 4,762,437 | 8/1988 | Mitomi | 403/406.1 |
| 4,812,097 | 3/1989 | Moulton | 411/347 |
| 4,902,181 | 2/1990 | Moulton | 411/347 |
| 5,267,828 | 12/1993 | Lenhart et al. | 415/9 |
| 5,718,549 | 2/1998 | Noda et al. | 411/553 |

FOREIGN PATENT DOCUMENTS

| | | | |
|---|---|---|---|
| 364032004A | 2/1989 | Japan | 415/169.3 |
| 1411057 | 10/1975 | United Kingdom | 415/169.3 |

*Primary Examiner*—Edward K. Look
*Assistant Examiner*—Matthew T. Shanley
*Attorney, Agent, or Firm*—Burns, Doane, Swecker & Mathis, L.L.P.

[57] ABSTRACT

A guide blade for steam turbines, having in the blade interior a cavity (18) to which a vacuum is applied, is provided with an opening (3) for drawing off fluid in the region of the trailing blade edge (4). This opening is provided with a porous cover (7). The cover is dimensioned in such a way that, during operation, all its capillaries are filled with the fluid to be drawn off. It is anchored in the guide blade by a mechanical fastening element (20).

The mechanical fastening element (20) is a spring-loaded quick-acting lock and comprises a bush (21) which fixes the cover in the blade opening (3) and projects with its cylindrical part (24) into the blade cavity (18), and a pin (25) which is axially displaceable in the interior of the bush, is equipped with spring means (26) and is provided at its end with a cap (28), which rests on the inner wall of the blade.

4 Claims, 4 Drawing Sheets

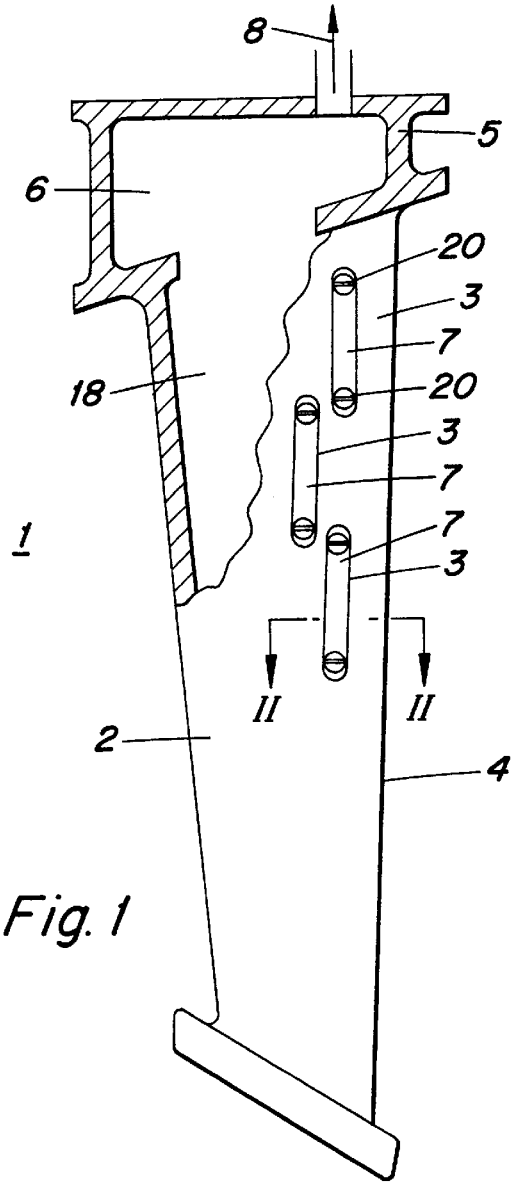
Fig. 1
Fig. 2
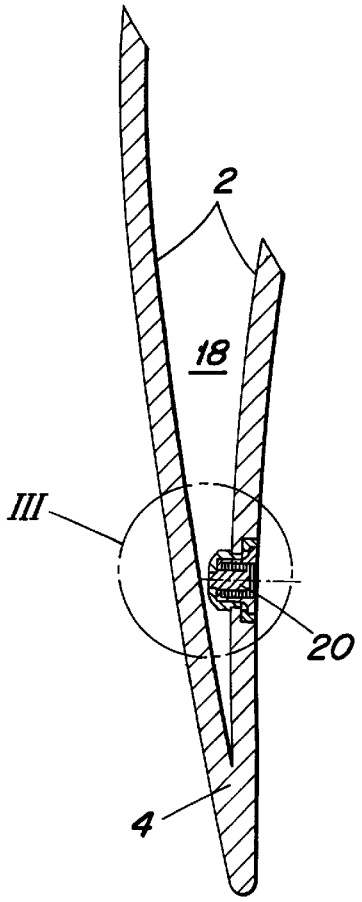
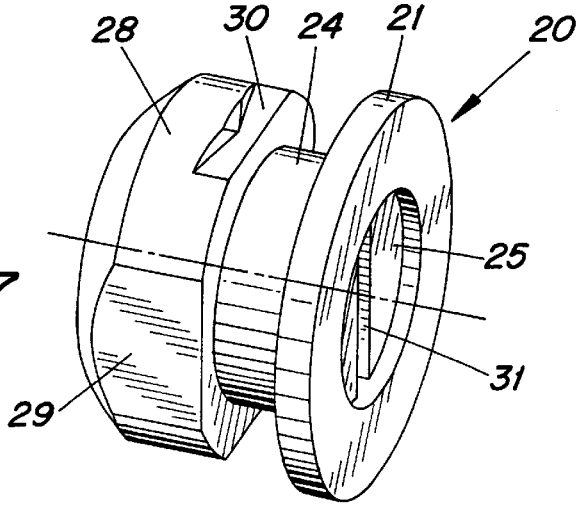
Fig. 7

GUIDE BLADE FOR STEAM TURBINES

BACKGROUND OF THE INVENTION

1. Field of the Invention

The invention relates to a guide blade for steam turbines, having in the blade interior a cavity to which a vacuum is applied, and having at least one opening, which is provided with a porous cover having capillaries, for drawing off fluid from the trailing blade surface, preferably in the region of the blade edge, the opening leading into the cavity, and the cover being dimensioned in such a way that, during operation, all the capillaries are filled with the fluid to be drawn off.

2. Discussion of Background

In the low-pressure part of steam turbines, guide blades which are provided with a means for drawing off water are generally known. Guide blades of this type have openings, for example in the region of their trailing edge, which are formed as slits parallel to the blade edge or as bores and which lead into a cavity in the interior of the guide blade. The cavities of all the guide blades are connected to an annular duct, which is itself connected to the condenser of the steam-turbine plant. From the condenser, a comparatively low vacuum is applied to the cavity in the interior of the guide blade. By means of this vacuum, water condensed on the surface of the guide blade is drawn into the openings and passes on from there into the condenser. Without the water being drawn off in this way, water droplets would form on the guide blade and these would separate from the blade edge located downstream and come into contact with the moving blades of the steam turbine, which rotate at high speed. The moving blades can be eroded to a considerable extent by the water droplets coming into contact with them. This source of erosion can be eliminated by drawing off the water.

Through these openings, which have a comparatively large cross section, steam is also, as a rule, drawn off together with the water, a factor which brings about a reduction in the efficiency of the steam turbine. Furthermore, the edges of these openings disturb the steam flow along the guide blades.

In addition, it is known from DE-A1-2 038 047 to cover these openings, intended for drawing off the water, with a porous material which is permeable to liquid. By means of a comparatively large pressure gradient, the porous material is partly sucked empty in a continuous manner in order to create sufficiently open pores, into which the water wetting the blade surface is then drawn by means of the capillary action. The water is then drawn out of the pores into the blade cavity by means of the pressure gradient. When the comparatively large pressure gradient is utilized in this way, a certain proportion of the steam flowing around the blade is likewise drawn off as well despite the porous cover, a factor which results in a reduction in the output of the turbine. A comparatively large quantity of energy is consumed in order to maintain the comparatively large pressure gradient for drawing off the water.

DE-A1-195 04 631 discloses a guide blade of the type mentioned at the beginning. In this guide blade, a wall which withstands the application of a vacuum is formed by the porous cover and the liquid-filled capillaries. This wall is only permeable to the fluid where it is wetted by the fluid. The porous cover has a pore size which is matched to the fluid to be drawn off and to the vacuum. The openings for drawing off the fluid have a comparatively small effective cross section. During operation, there is always an impervious wall between the inner cavity to which a vacuum is applied, and the turbine interior, which is exposed to steam, which wall is composed of the porous material of the cover and the fluid contained in all the capillaries of this cover. This impervious wall constantly withstands the pressure gradient, designated as barrier pressure, between the turbine interior and the inner cavity to which a vacuum is applied. Although the water which wets the surface of the guide blade passes through this wall, steam cannot be entrained in the process, since, for the steam, the wall is solid and impermeable. The efficiency of the steam turbine is not significantly reduced by the water being drawn off at the guide blades, but its availability is substantially increased, since erosion phenomena caused by water droplets now no longer occur.

The openings for the covers are formed in the blade in the region of the trailing edge as a single-part or multi-part groove running parallel to the blade edge. The porous cover is connected to the guide blade by full-surface or spot brazing, by welding, by adhesive bonding and/or by mechanical peening. All these known fastening methods make it more difficult to exchange the cover if the need arises.

SUMMARY OF THE INVENTION

Accordingly, one object of the invention is to provide a novel guide blade of the type mentioned at the beginning with detachable means for drawing off fluid.

According to the invention, this is achieved by the porous cover being anchored in the guide blade by a mechanical fastening element.

It is expedient if the fastening element is a spring-loaded quick-acting lock, essentially comprising a bush which projects into the blade cavity, and a pin which is axially displaceable in the interior of the bush, passes through the base of the bush and is provided at its end with a cap, which rests on the inner wall of the blade. An extremely flat element which can be attached as close as possible to the trailing blade edge, which is to be drained, can be conceived with this measure.

It is useful if the the cap is provided at its cylindrical outer circumference with four flats. Two flats located opposite one another are selected in such a way that, upon insertion into the blade cavity, the cap passes through the opening counter to the spring force. The cap is then rotated through 90°by means of the pin and by means of the spring force is pressed, by way of two further flats located opposite one another, onto the inner walls of the blade which define the opening. The cover can thus be fitted and removed in an extremely simple manner.

If the spring means are formed from a stack of disk springs, the contact or prestressing forces can be adapted to the existing conditions by appropriate spring selection.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a guide blade provided with three staggered covers;

FIG. 2 shows a partial section through the guide blade along line II—II in FIG. 1;

FIG. 7 shows a prefabricated fastening element which is ready for fitting.

DESCRIPTION OF THE PREFERRED EMBODIMENTS

Figure 3:
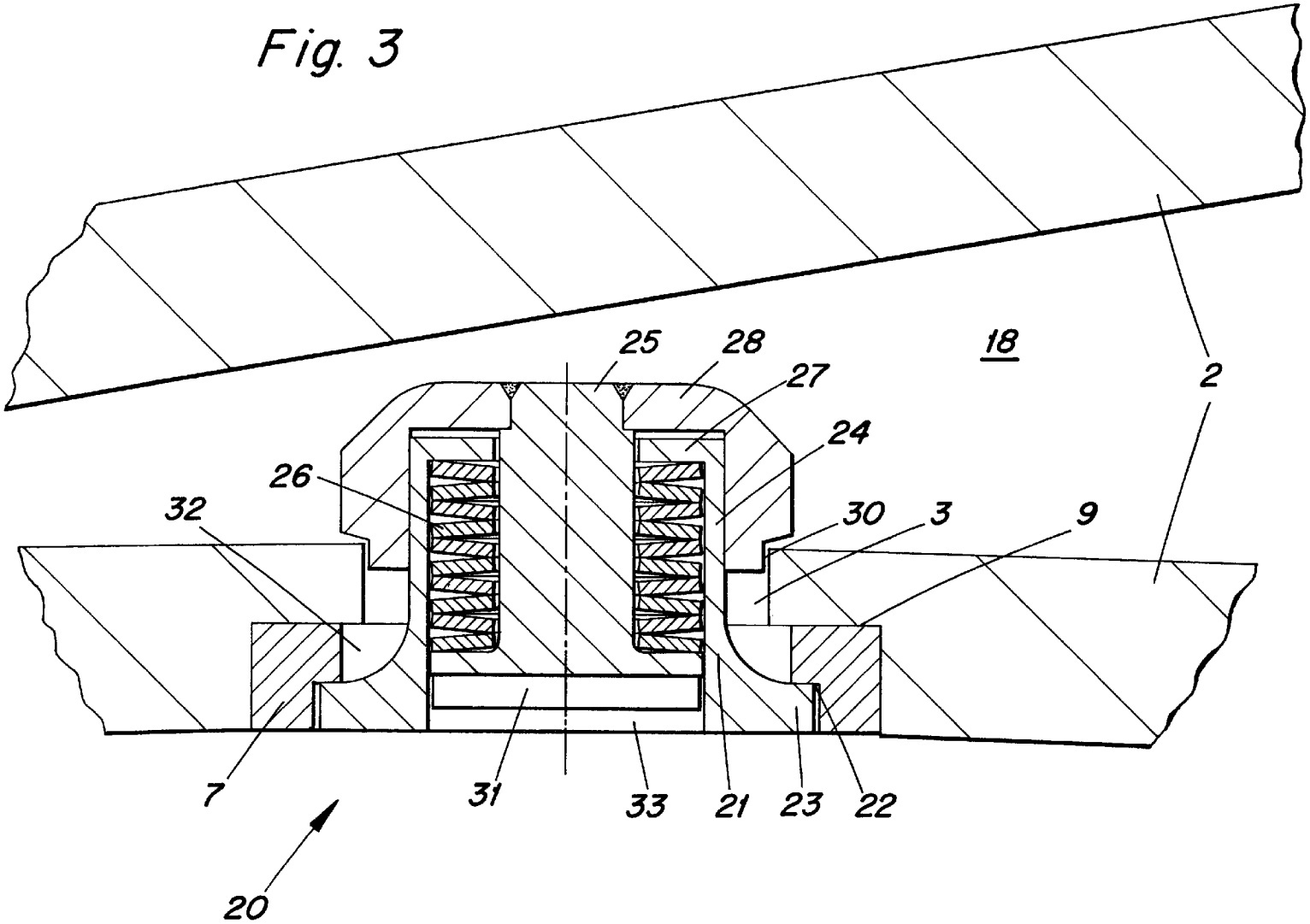
FIG. 3 shows the detail III from FIG. 2.

Referring now to the drawings, wherein like reference numerals designate identical or corresponding parts throughout the several views, FIG. 1 shows a diagrammatic sketch of a guide blade 1 of a steam turbine, the blade body 2 of which is welded together from two preformed plates and which is connected to the root 5 by means of a welded joint. A plurality of openings 3, which overlap one another and are in the form of elongated grooves, are milled in the surface of the blade body 2. These openings 3 extend parallel to the trailing blade edge 4, which is situated downstream. These grooves 3 need not extend over the entire length of the guide blade 1 but are only provided where liquid is to be drawn off. As a rule, the radially outer third of the blade will be equipped with the means for drawing off the liquid.

Provided in the root 5 of the guide blade 1 is a cavity 6, which extends into the inner cavity 18 of the blade body 2. The grooves 3 lead into this cavity 18. The cavities 6 and 18 are connected to the condenser (not shown) of the steam-turbine plant, the condenser being under vacuum and therefore the cavities 6 and 18 themselves being under vacuum. The outflow direction of the water to be drawn off from the cavity 6 into the condenser is designated by 8.

To draw off water, each groove 3 is provided with a porous cover 7, which closes the groove off from the surface of the blade body 2. The porous cover 7, in the form of a strip of a highly porous sintered material on a chrome/nickel basis, rests on a step 9 of the groove flank (FIG. 3). The differential pressure at the porous cover 7 is normally within the range of 10 to 50 mbar, preferably about 20 mbar.

It was verified in a test arrangement that water flowing in thin streams over the blade body 2 can be drawn off in the desired quantities. It could clearly be seen, in particular, that the water was immediately drawn into the capillaries of the porous cover 7. The differential pressure of 20 mbar is sufficient here in order to deliver the water through the porous cover 7 into the groove 3.

Figure 4:
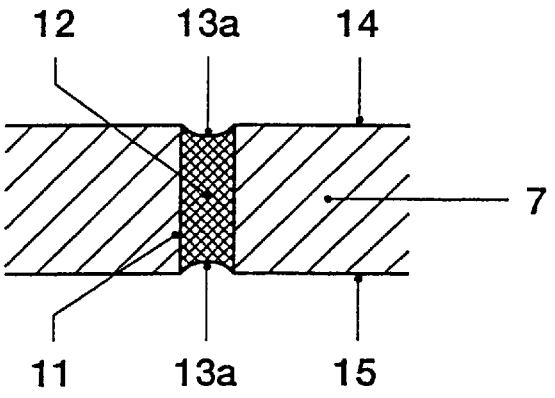
FIG. 4 shows a section through a capillary of a porous cover impregnated with a fluid.
Figure 4A:
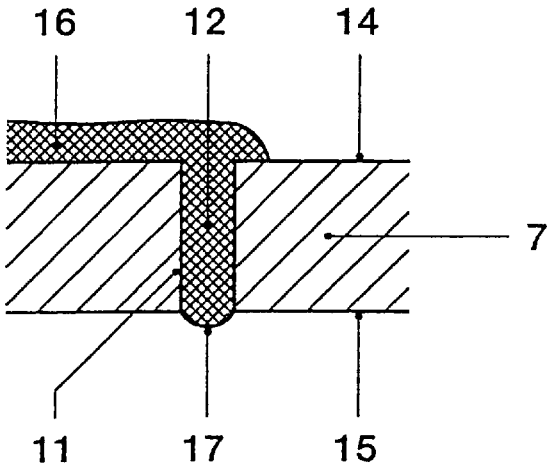
FIGS. 4*a* and 4*b* show the passage of the fluid through the porous cover.
Figure 4B:
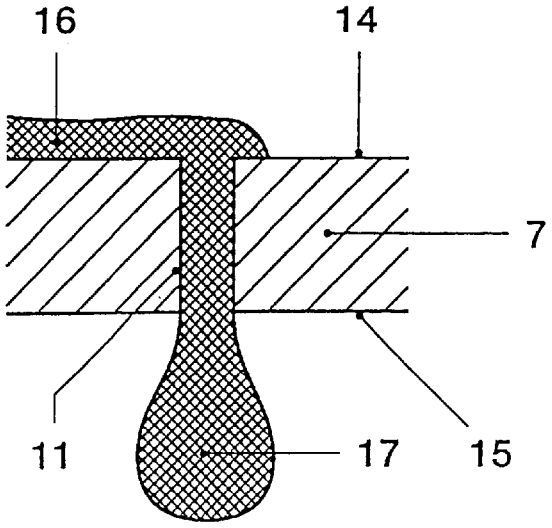

To explain the mode of operation, FIGS. 4, 4*a* and 4*b* may be considered in more detail. A schematic section through an individual capillary 11 (shown in simplified form) of a porous cover 7 completely impregnated with a fluid is shown. The capillary 11, like all the other capillaries 11 of the porous cover 7, is filled with a fluid. The capillaries 11 are interlinked in the porous cover 7, so that, when a fluid comes into contact with one point of the porous cover 7, all the capillaries 11 are immediately filled with this fluid. In steam turbines, the fluid is usually distilled water. On account of the surface tension of the water and on account of the capillary action, a water column 12 forms in the capillary 11. A meniscus 13*a*, 13*b* forms in each case on both sides of the water column 12 which face the respective surface of the porous cover 7. The shape of the meniscus 13*a*, 13*b* is determined by the surface tension of the water. The meniscus 13*a* is assigned to that side of the porous cover 7 which is exposed to steam. The surface 14 of the porous cover 7 is likewise assigned to the side which is exposed to steam, whereas the surface 15 of this cover is assigned to the condenser side, that is to say to that side of the cover 7 to which a vacuum is applied.

Normally, the water column 12 lasts continuously; it is not removed from the capillary 11, or from all the capillaries 11, by the applied pressure difference, the so-called barrier pressure. The porous cover 7 forms, with the water columns 12 present in all the capillaries 11, a pressure-tight wall which always withstands the applied barrier pressure, so that no steam can be drawn off through this wall into the condenser, so that, in this embodiment of the porous cover 7, there is no loss of efficiency of the turbine plant as a result of steam losses.

According to FIG. 4*a*, a stream 16 of water condensed on the guide blade 1 flows over the surface 14. As soon as this stream 16 reaches a capillary 11, the top meniscus 13*a* of the water column 12 is destroyed. The capillary action and the surface tension of the bottom meniscus 13*b* are now no longer sufficient in order to keep the water column 12 stationary; the water from the stream 16 penetrates into the capillary 11 and the bottom meniscus 13*b* turns into a bulge 17. On account of the water subsequently flowing through the capillary 11, the bulge 17 assumes a droplet shape, as shown in FIG. 4*b*. The water droplet which is thus produced then drips off and is delivered into the condenser by the vacuum. This dripping takes place until all the water of the stream 16 has flown off into this and the adjacent capillaries 11. After the last residue of water has flown off and dripped off, the capillaries 11 filled with the water column 12 remain behind and seal off the porous cover 7 from the barrier pressure again and thus avoid an undesirable passage of steam. It proves to be especially advantageous if the entire surface 15 assigned to that side of the cover 7 to which a vacuum is applied is available for the dripping, since the water is distributed by the inter-linked capillaries in such a way that it comes out over the entire surface 15. This arrangement is readily suitable for the passage of comparatively large quantities of water.

Figure 5:
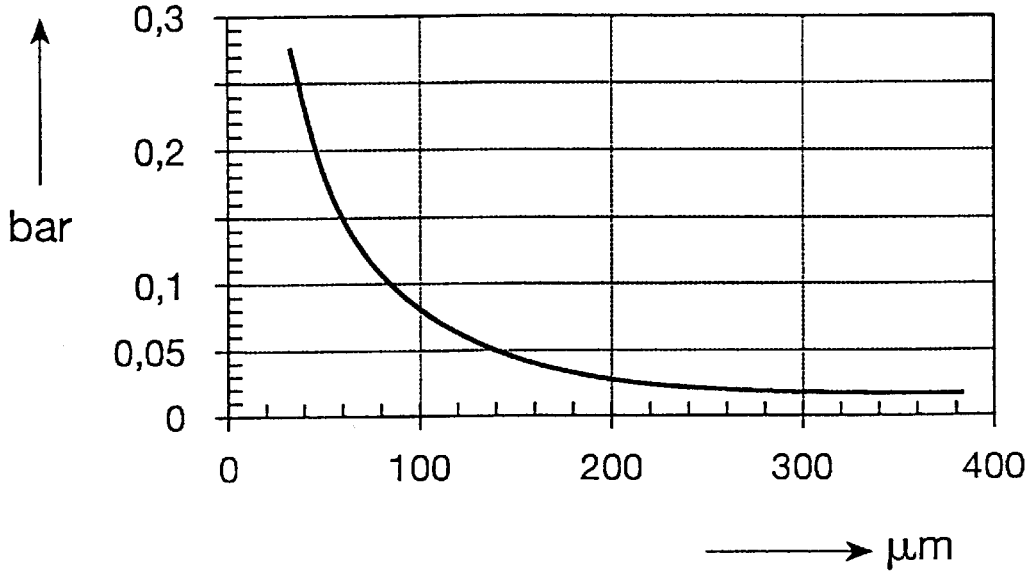
FIG. 5 shows the barrier pressure which is held by the fluid-impregnated porous cover plotted against the grain size of the material used for making the porous cover.

In FIG. 5, the barrier pressure which is held by the fluid-impregnated porous cover 7 is plotted against the grain size of the material used for making the porous cover 7, and thus indirectly against the size of the capillaries 11. The barrier pressure is plotted in bar on the ordinate of this diagram, and the average grain size of the material used for making the porous cover 7 is plotted in $\mu$m on the abscissa. A coarser grain of the material particles used inevitably results in larger diameters of the capillaries 11 during sintering. The meniscus 13*a*, 13*b* therefore likewise have a larger area to which the barrier pressure is applied. If the capillary 11 must not be emptied by the barrier pressure, the barrier pressure must be reduced accordingly.

Figure 6:
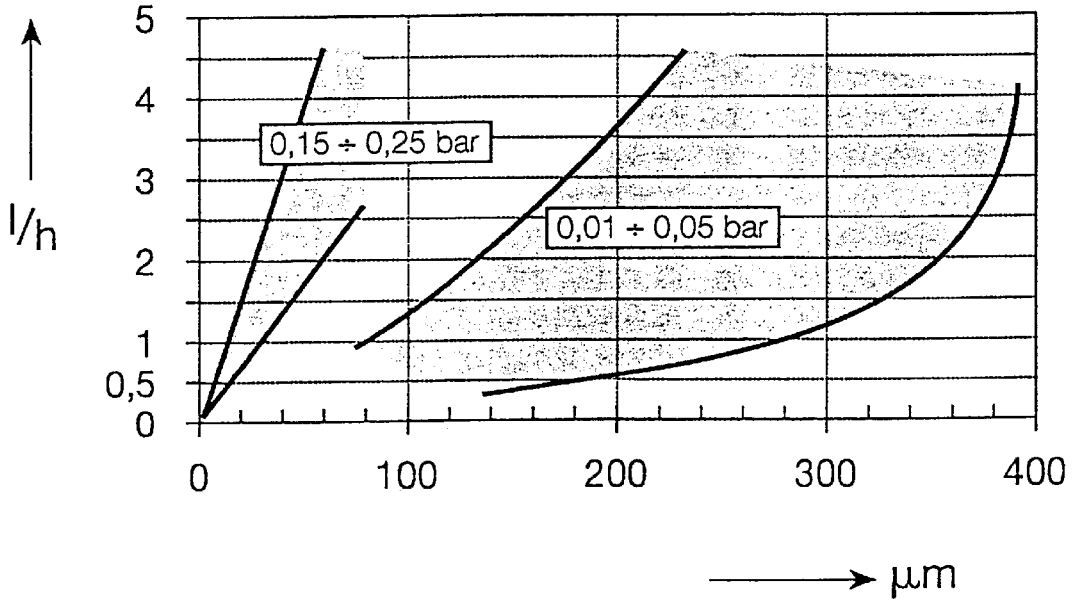
FIG. 6 shows the quantity of the fluid passing through the porous cover plotted against the grain size of the material used for making the porous cover and against the pressure acting on the cover.

In FIG. 6, the quantity of the water passing through the porous cover 7 is plotted against the grain size of the material used for making the porous cover. As a further parameter, the barrier pressure acting on the cover 7 is indicated in the diagram. The water quantity passing per hour through a porous cover 7 having an effective area of 10 $cm^2$ is plotted on the ordinate of this diagram, and the average grain size of the material used for making the porous cover 7 is plotted in $\mu$m on the abscissa. It can clearly be seen from this diagram that a coarser grain of the material particles used inevitably results in larger diameters of the capillaries 11 during sintering and also, in combination therewith, in larger quantities of the water passing through. In the model test taken as a basis, the water comes into contact with the porous cover 7 in the form of an individual stream 16 and wets an area of the surface 14 of about 50 $mm^2$. The water is distributed in the capillary system of the porous cover 7 and comes out over the entire surface 15 of the cover 7, to which a vacuum is applied, the surface area in this case being about 1000 $mm^2$, which is available for the dripping action of the water which passes through. Only in this way is it at all possible to discharge has such comparatively large quantities of water through the porous cover 7. It has clearly been found that, with porous covers 7 of such design, the quantities of condensed water which accumulate at the guide blades 1 in modern steam turbines can be discharged satisfactorily.

The cover placed on the step 9 must be fixed to the guide blade in a suitable manner. According to the invention, this connection is now made to be detachable. The local position of a fastening element in the region of the trailing blade edge 4 is shown in FIG. 2 in a partial section. A preferred embodiment variant of the fastening element is shown on an enlarged scale in FIGS. 3 and 7.

As can be seen from FIG. 3, the cover 7 provided with the capillaries rests on a step 9 of the groove 3, which step is arranged in the blade wall 2. On its outside, which is directed toward the duct through which flow occurs, the cover is flush with the outer wall of the blade. In the region of the fastening element 20, it is provided with a preferably cylindrical through-bore 32, which in turn has a recess 22.

The mechanical fastening element 20 is designed as a spring-loaded quick-acting lock. Stainless steel is preferably used as the material for it. On the one hand, this fastening element comprises a bush 21, which fixes the cover in the blade opening 3 via an annular flange 23 lying in the recess 22. The bush projects with its cylindrical part 24 into the blade cavity 18. On the other hand, an axially displaceable pin 25 which is equipped with spring means 26 is provided in the interior of the bush. The spring means 26 here is a stack of disk springs, which are put one over the other and are guided between the pin base 33 and the base 27 of the bush. The pin passes through this base 27 of the bush and is provided at its end with a cap 28, which rests on the inner wall of the blade. The cap is preferably welded to the pin. In the fitted state, it is guided with the inner walls of its hollow part on the cylindrical outer wall of the bush and can slide along the latter.

The cap 28 is provided at its cylindrical outer circumference with four flats. Two flats 29 (FIG. 7) located opposite one another extend over the entire cap height and their dimensions are selected in such a way that, upon insertion into the blade cavity, the cap passes through the groove 3. To insert the cap completely, the pin is lifted counter to the spring force by means of a tool. To this end, the pin base is provided with a slot 31 for receiving, for example, a screwdriver.

By means of a rotation of the pin through 90°, the cap is then brought to bear on the inner walls of the blade which define the opening 3. The two further flats 30 located opposite one another, which are made merely on the bottom part of the cap, are provided in order to bring the cap to bear in this way. They are dimensioned in such a way that, when the pin is relieved, the cap is lowered onto the margins of the groove as a result of the spring force and sits therein with slight lateral clearance.

The invention is, of course, not restricted to the exemplary embodiment shown and described.

If, for example, condensed water is expected in particularly large quantities at certain locations of the guide blade 1, large-area porous covers 7 may also be provided there instead of the narrow strips shown, and the grooves 3 may be completely or partly replaced by openings formed in accordance with the more extensive requirements. Depending on the length of the covers, more than two fastening elements per cover, as shown in FIG. 1, may also be provided.

Unlike the hollow blade shown, the guide blade may, of course, just as easily be of solid design and be cast, for example, from GGG40. A groove-shaped opening 3 may then be cast, or milled, in the surface of the blade body. The requisite step 9 is eroded or milled by a copy milling machine. During the milling operation, it is ensured, at the same time, that casting residues which could reduce the groove cross section to an inadmissible degree are removed. The root of the guide blade will, in turn, have a cavity 6 into which the groove provided with the porous cover 7 leads.

As a detachable mechanical fastening element, a simple screw connection is likewise conceivable, in which case countersunk or hexagon-head screws screwed into the blade wall may be used. Here, the hexagon-head screws can hold down the cover either in each case via a washer or via a shim extending over the length of the filter. In the case of countersunk screws, the latter may act with part of their circumference directly on the filter, which is provided with a corresponding bevel. The disadvantage with these solutions is that threads have to be made in the blade walls.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A guide blade for steam turbines, having in the blade interior a cavity to which a vacuum is applied, and having at least one opening, which is provided with a porous cover having capillaries, for drawing off fluid from the blade surface, the opening leading into the cavity, and the cover being dimensioned in such a way that, during operation, all the capillaries are filled with the fluid to be drawn off wherein the porous cover is anchored in the guide blade by a mechanical fastening element, which is a spring-loaded quick-acting lock.

2. The guide blade as claimed in claim 1, essentially comprising a bush which fixes the cover in the blade opening via an annular flange lying in a recess of the cover and projects with its cylindrical part into the blade cavity, and a pin which is axially displaceable in the interior of the bush, is equipped with spring means, passes through the base of the bush and is provided at its end with a cap, which rests on the inner wall of the blade.

3. The guide blade as claimed in claim 2, wherein the cap is provided at its cylindrical outer circumference with four flats, of which two flats located opposite one another are selected in such a way that, upon insertion into the blade cavity, the cap passes through the opening, is then rotated through 90° by means of the pin and by means of the spring force is pressed, by way of two further flats located opposite one another onto the inner walls of the blade which define the opening.

4. The guide blade as claimed in claim 2, wherein the spring means are formed from a stack of disk springs.

* * * * *